US009140432B2

(12) United States Patent
Leighton

(10) Patent No.: US 9,140,432 B2
(45) Date of Patent: Sep. 22, 2015

(54) MODULAR LAMP

(71) Applicant: Jeffrey A. Leighton, Halifax, PA (US)

(72) Inventor: Jeffrey A. Leighton, Halifax, PA (US)

( * ) Notice: Subject to any disclaimer, the term of this patent is extended or adjusted under 35 U.S.C. 154(b) by 0 days.

(21) Appl. No.: 14/021,742

(22) Filed: Sep. 9, 2013

(65) Prior Publication Data

US 2015/0070917 A1 Mar. 12, 2015

(51) Int. Cl.
*F21V 17/00* (2006.01)

(52) U.S. Cl.
CPC ..... *F21V 17/002* (2013.01)

(58) Field of Classification Search
CPC ..... B44C 3/12; F21V 21/03; F21V 5/06; F21W 2121/00
USPC ..... 362/431; 248/317, 342, 343
See application file for complete search history.

(56) References Cited

U.S. PATENT DOCUMENTS

| | | | | |
|---|---|---|---|---|
| 5,567,045 | A * | 10/1996 | Bucek | 362/363 |
| 2005/0146864 | A1 * | 7/2005 | Haddad et al. | 362/145 |
| 2009/0080203 | A1 * | 3/2009 | McCauley | 362/368 |
| 2012/0047801 | A1 * | 3/2012 | Hogan | 47/66.6 |

* cited by examiner

*Primary Examiner* — Tracie Y Green
(74) *Attorney, Agent, or Firm* — Maier & Maier, PLLC

(57) ABSTRACT

A modular lamp apparatus and system. In one exemplary embodiment, the modular lamp can include a shell with a first shell piece and at least a second shell piece, and a hook affixed to one of an interior wall of the first shell piece or an interior wall of the second shell piece; and a skeletal structure comprising a pole, a pole base, and a light fixture, the pole having a hole that receives the hook to couple the skeletal structure in place relative to the shell when the first shell piece and the second shell piece are combined to form the shell, wherein at least a portion of the skeletal structure is contained within a shell interior of the shell when the first shell piece and the second shell piece are combined to form the shell.

15 Claims, 3 Drawing Sheets

MODULAR LAMP

BACKGROUND

A majority of lamps in the marketplace today are provided for the major purpose of illumination, such as a reading light, bed-end light, or to light up a reading room, bed room, bath room, family room, living room, or dining room. However, societal trends are continuously increasing the importance of the design of homes, offices, restaurants, bars, and other private and public places. Although some lamps serve a secondary decorative function, they exist for the major purpose of illumination rather than decoration. Further, those that do serve some decorative purpose only have a singular exterior design.

In some settings, the emphasis on design has increased so much so that the decorative purpose of lamps has become the major goal of their existence. This presents a major problem because modern standards for design now change at such a rapid pace, often seasonally, that lamps become outdated and undesirable to consumers within months of their creation. Therefore, to avoid having to replace lamps in their entirety every time trends change, the marketplace needs a decorative lamp that can have its exterior design easily exchanged.

SUMMARY

A modular lamp apparatus and system. In one exemplary embodiment, the modular lamp can include a shell with a first shell piece and at least a second shell piece, and a hook affixed to one of an interior wall of the first shell piece or an interior wall of the second shell piece; and a skeletal structure comprising a pole, a pole base, and a light fixture, the pole having a hole that receives the hook to couple the skeletal structure in place relative to the shell when the first shell piece and the second shell piece are combined to form the shell, wherein at least a portion of the skeletal structure is contained within a shell interior of the shell when the first shell piece and the second shell piece are combined to form the shell.

In another exemplary embodiment, a system for providing a modular lamp may be described. The system can include a shell having a first shell piece and at least a second shell piece, wherein a hook is affixed to one of an interior wall of the first shell piece or an interior wall of the second shell piece; and a skeletal structure comprising a pole, a pole base, and a light fixture; wherein the pole has a hole that receives the hook to allow the skeletal structure to be securely coupled in place relative to the shell when the first shell piece and the second shell piece are coupled to form the shell, and at least portions of the skeletal structure are contained within a shell interior of the shell when the first shell piece and the second shell piece are coupled to form the shell.

In still another exemplary embodiment, a modular lamp apparatus may be described. The modular lamp apparatus can have a shell comprising a first shell piece and at least a second shell piece; a skeletal structure with a pole, a pole base, and a light fixture; means for coupling the first shell piece and the second shell piece to form the shell; and means for coupling the skeletal structure in place relative to the shell.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention," "embodiments," or "invention" do not require that all embodiments of the invention include the discussed feature, advantage or mode of operation.

Generally referring to the accompanying drawings, a modular lamp device may be formed in any of a variety of manners and may be used in any of a variety of situations. An exemplary embodiment may appear similar to device 100, although other forms and designs are envisioned. An exemplary situation where the device might be used is in a home, office, restaurant, bar, and other private and public places, where a lamp with a singular exterior design is deemed to be insufficient to keep up with the changing design themes of its surroundings.

Figure 1:
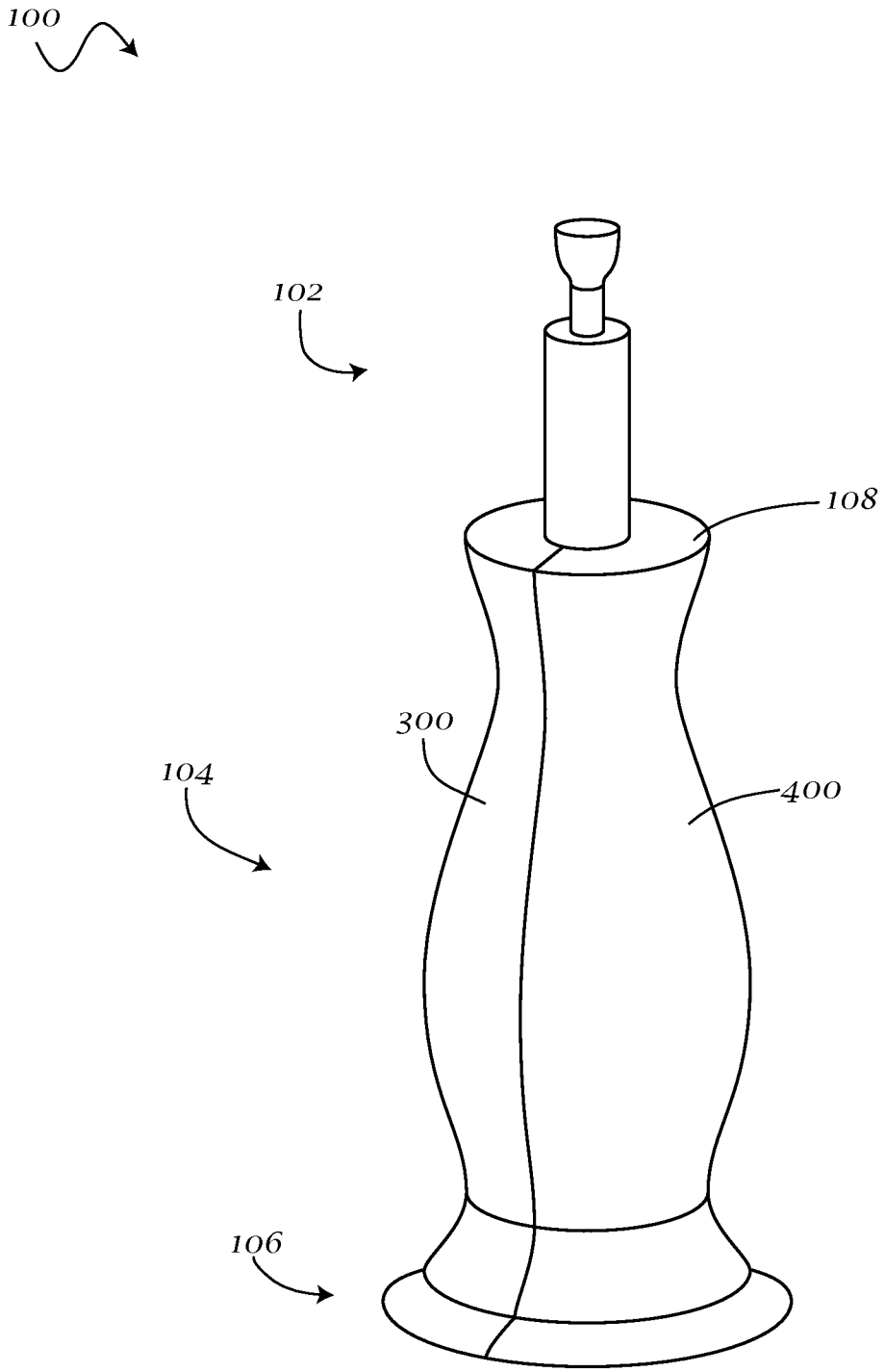
FIG. 1 is a perspective view of an exemplary embodiment a standing modular lamp.

Referring to exemplary FIG. 1, the modular lamp 100 may include a light fixture 102 and a shell 104. The shell 104 may have fluting, decorative finishes, ornamental appearances and coloring, or any other accents or decorations that may be found on a lamp. The shell 104 may include a base 106 and a top surface 108. The shell 104 can be designed to be any structural shape known in the art. The shell 104 can provide decorative appeal to any location where the modular lamp 100 may be situated. The shell 104 may also serve to house some or all of a skeletal structure 200. The base 106 may provide support that enables the lamp 100 to stand vertically when placed on a substantially level surface. The light fixture 102 may include any known light fixture structures, for example, one or more lighting elements, a switch mechanism for controlling illumination intensity, electrical circuitry for connecting to a power source, and a lamp shade.

The shell 104 may be composed of a number of separable pieces, for example two pieces, shell piece 300 and shell piece 400, respectively. Shell piece 300 and shell piece 400 may substantially mirror each other in appearance. For example, a design theme may be continuous throughout shell piece 300 and shell piece 400 when they are coupled. Such a binary construction can allow for multiple shells of different designs to be interchangeably combined with the same light fixture 102. Additionally, in some other exemplary embodiments, shell 300 and shell 400 may be substantially different, but may nevertheless include compatible elements for the coupling of the two pieces.

Figure 2:
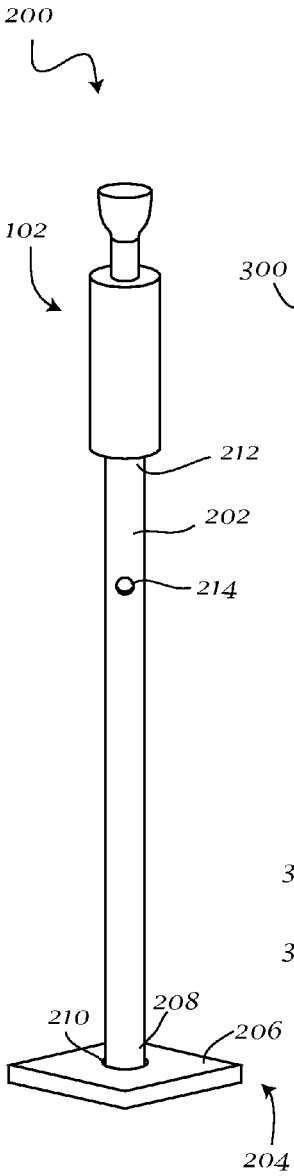
FIG. 2 is a perspective view of the front of an exemplary embodiment of a skeletal structure of a modular lamp.

Turning now to exemplary FIG. 2, a perspective view of the front of the skeletal structure 200 of modular lamp 100 may be shown. Skeletal structure 200 may be constructed of a pole 202, a pole base 204, and a light fixture 102. Pole 202 may be similar to known types of lamp poles and may be formed out of any desired material, for example metal. A bottom end 208 of pole 202 may fit into a cavity 210 of the pole base 204 such that the pole 202 may extend vertically upward from the pole base 204. The pole base 204 may be weighted to provide support and stability to the modular lamp 100. Also, pole base 204 may have a top surface 206. An upper end 212 of the pole 202 may be coupled to the light fixture 102. Light fixture 102 may be similar to known types of illuminating fixtures and may be powered by any desired power source, for example electrical outlet, battery, or solar. The upper portion of the pole 202 can have a hole 214. A hole 214 can allow for a coupling the shell 104 to the skeletal structure 200. It may further be appreciated that the structure 200 could be inverted such that a bottom end 208 may be open and a top portion, such as top surface 108, so that the orientation of the light bulb would be substantially inverted. Additionally, structure 200 could be suspended from any desired surface, for example a ceiling.

Figure 3:
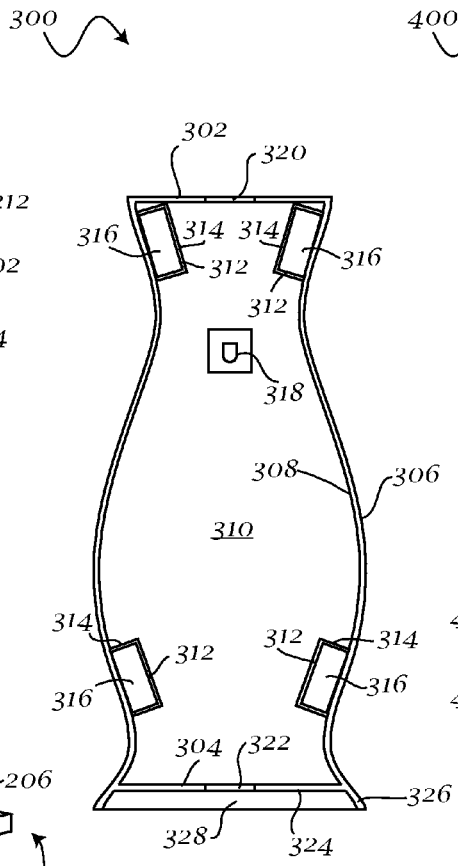
FIG. 3 is a front view of an exemplary embodiment of a first shell piece.
Figure 4:
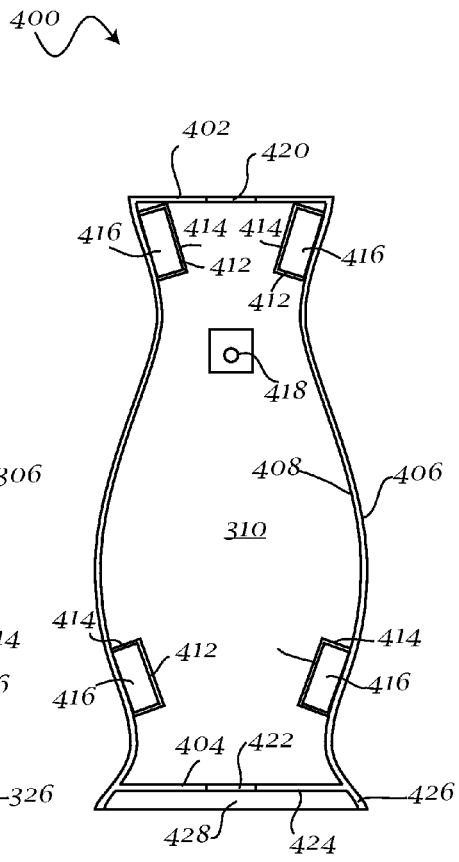
FIG. 4 is a front view of an exemplary embodiment of a second shell piece.

Turning now to exemplary FIG. 3, a front view of the shell piece 300 may be shown. The shell piece 300 may have a top portion 302, a bottom portion 304, an exterior wall 306, and an interior wall 308. Within a shell interior 310 of the shell piece 300, a number of magnets 312, for example four magnets, may be affixed to the interior wall 308. The magnets 312 may be affixed in any known manner, for example through the use of magnet casings 314. The magnets 312 can be disposed such that an active face 316 of each magnet 312 may be disposed substantially parallel to a facial plane of the shell piece 300. Exemplary FIG. 4 may show a front view of a shell piece 400, which may be coupled to shell piece 300 to form an exemplary binary construction embodiment of shell 104. Like shell piece 300, shell piece 400 may have a top portion 402, a bottom portion 404, an exterior wall 406, an interior wall 408, and a number of magnets 412 affixed with casings 414 and having active faces 416, all of which may substantially mirror the counterparts included in shell piece 300. The magnets 312 may have a charge that is opposite to a charge of the magnets 412 such that when aligned in proximity to one another magnets 312 and magnets 412 can attract to each other and can allow for a secure coupling of the shell piece 300 with shell piece 400 to form the shell 104 having the shell interior 310.

When combined, the shell interior 310 can house the pole 202 of the skeletal structure 200. Within shell piece 300, a hook 318 may be affixed to the interior wall 308, such that the hook 318 can be received into the hole 214 of the pole 202 of the skeletal structure 200 when the shell pieces 300 and 400 are coupled. This can securely couple the skeletal structure 200 in place relative to the shell 104. Additionally, the hook 318 may be further received into hook receptacle 418. This can allow for additional security in the coupling of the shell piece 300 with shell piece 400 to form the shell 104 and for additional security in the coupling of the skeletal structure 200 in place relative to the shell 104. The top portions 302 and 402 may have a top groove 320 and 420, respectively, which can allow for the upper end 212 of the pole 202 to protrude vertically upward through the shell 104 such that from the exterior it appears that the lighting fixture 102 is affixed to the top surface 108 of the shell 104. Similarly, the bottom portions 304 and 404 may have a bottom groove 322 and 422, respectively, which can allow for the bottom end 208 of the pole 202 to protrude vertically downward through the shell 104 such that the top surface 206 of the pole base 204 may be adjacent to a bottom surface 324 of the shell 104. The base 106 may be made up of base pieces 326 and 426, which extend substantially downward from bottom portions 304 and 404, respectively, so as to conceal the pole base 204 within spaces 328 and 428 from the exterior surface when the modular lamp 100 is assembled and placed on a level surface for normal use.

Figure 5:
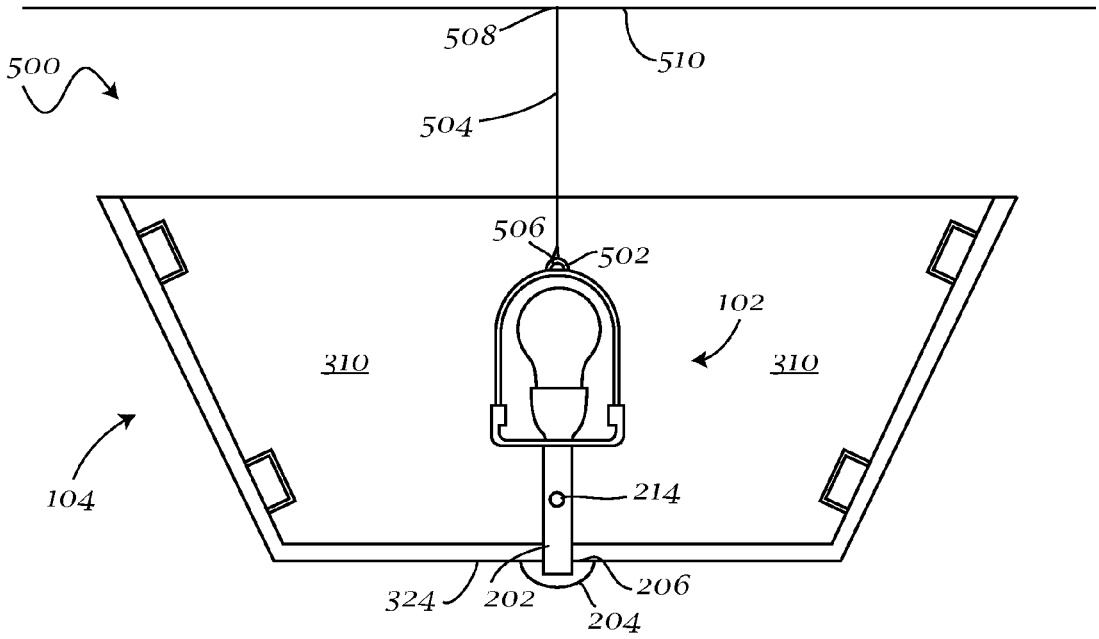
FIG. 5 is a cutaway front view of an exemplary embodiment of a shell piece and skeletal structure of a pendulant modular lamp.

Exemplary FIG. 5 may show an alternative embodiment of modular lamp 100 that may be a pendulant modular lamp 500 that may include a light fixture 102 and a shell 104. Here, light fixture 102 may include an upper loop 502 to which a bottom end 506 of a hanging member 504 can be coupled to, for example via hooking or tying. An upper end 508 of the hanging member 504 may be affixed to a ceiling 510 that may allow the pendulant modular lamp 500 including the bottom surface 324 and pole base 204 to hang suspended above any surface below. In this exemplary embodiment, the pole base 204 may function as a knob such that the top surface 206 of the pole base 204 may be adjacent to a bottom surface 324 of the shell 104 in a way that prevents gravitational forces from causing shell 104 to slide off of pole 202. Note that while exemplary FIG. 5 may show the pendulant modular lamp 500 that includes the shell 104 that is in the fashion of a lampshade with an open top, other designs for shell 104 of a pendulant modular lamp are within the purview of the invention. For example, the shell 104 may be a complete enclosure or a nearly complete enclosure with a minimally open top.

Figure 6:
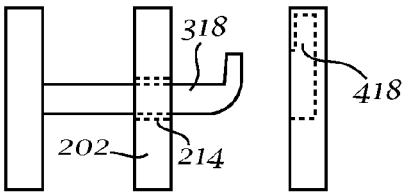
FIG. 6 is a side view of an exemplary embodiment of a pole with a hole of a skeletal structure, a hook of a first shell piece, and a hook receptacle of a second shell piece.

Turning now to exemplary FIG. 6, a side view of the pole 202, hole 214, hook 318, and hook receptacle 418 may be shown. Hook 318 and hole 214 may be aligned such that hook 318 can be received by hole 214 when skeletal structure 200, shell piece 300, and shell piece 400 are coupled to form modular lamp 100. This can securely couple the skeletal structure 200 in place relative to the shell 104. Additionally, hook receptacle 418 may be aligned with hook 318 and hole 214 such that hook 318 may be further received into hook receptacle 418 when skeletal structure 200, shell piece 300, and shell piece 400 are coupled to form modular lamp 100. This can allow for additional security in the coupling of the shell piece 300 with shell piece 400 to form the shell 104 and for additional security in the coupling of the skeletal structure 200 in place relative to the shell 104.

In alternative embodiments different shell piece coupling mechanisms may be used instead of, or in conjunction with magnets 312 and 412. For example, Velcro™ or hook and loop fasteners, adhesives with a release layer and a corresponding receiving area or layer, latches, clips, hinges, or any other known coupling mechanisms may be utilized, as desired.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A modular lamp apparatus, comprising:

a shell comprising a first shell piece and at least a second shell piece, and a hook affixed to one of an interior wall of the first shell piece or an interior wall of the second shell piece; and a skeletal structure comprising a pole, a pole base, and a light fixture, the pole having a hole that receives the hook to couple the skeletal structure in place relative to the shell when the first shell piece and the second shell piece are combined to form the shell, wherein at least a portion of the skeletal structure is contained within a shell interior of the shell when the first shell piece and the second shell piece are combined to form the shell.

2. The modular lamp of claim 1, wherein a hook receptacle is affixed to one of an interior wall of the first shell piece or an interior wall of the second shell piece such that, after the hook is received by the hole, the hook is further received by the hook receptacle to couple the first shell piece to the second shell piece to form the shell and allowing the skeletal structure to be securely coupled in place relative to the shell.

3. The modular lamp of claim 2, wherein the hook receptacle is affixed to a non-edge portion of one of the interior wall of the first shell piece or the interior wall of the second shell piece.

4. The modular lamp of claim 1, wherein at least one or more first coupling mechanisms are affixed to the interior wall of the first shell piece, at least one or more second coupling mechanisms are affixed to the interior wall of the second shell piece, and the first coupling mechanisms and the second coupling mechanisms allow the first shell piece to be coupled to the second shell piece to form the shell.

5. The modular lamp of claim 4, wherein the first coupling mechanisms are affixed to an edge portion of the interior wall of the first shell piece and the second coupling mechanisms are affixed to an edge portion of the interior wall of the second shell piece.

6. The modular lamp of claim 4, wherein the first coupling mechanisms are affixed to the interior wall of the first shell piece and the second coupling mechanisms are affixed to the interior wall of the second shell piece such that the first shell piece and the second shell piece substantially mirror each other.

7. The modular lamp of claim 4, wherein the first coupling mechanisms are first magnets with a first charge, the second coupling mechanisms are second magnets with a second charge, and the first charge is opposite to the second charge such that there is an attractive magnetic force between the first magnets the second magnets that allows the first shell piece to be coupled to the second shell piece to form the shell.

8. The modular lamp of claim 4, wherein the first coupling mechanisms are hook fasteners, the second coupling mechanisms are loop fasteners, and the loop fasteners are positioned opposite to the hook fasteners such that when each loop fastener receives the opposing hook fastener, the first shell piece is coupled to the second shell piece to form the shell.

9. The modular lamp of claim 4, wherein the first coupling mechanisms are first latches, the second coupling mechanisms are second latches, and the second latches are positioned opposite to the first latches such that when each second latch receives the opposing first latch, the first shell piece is coupled to the second shell piece to form the shell.

10. The modular lamp of claim 4, wherein the first coupling mechanisms are first clips, the second coupling mechanisms are second clips, and the second clips are positioned opposite to the first clips such that when each second clip receives the opposing first clip, the first shell piece is coupled to the second shell piece to form the shell.

11. The modular lamp of claim 4, wherein the first coupling mechanisms are first hinges, the second coupling mechanisms are second hinges, and the second hinges are positioned opposite to the first hinges such that when each second hinge receives the opposing first hinge, the first shell piece is coupled to the second shell piece to form the shell.

12. The modular lamp of claim 4, wherein the first coupling mechanisms are adhesive layers, the second coupling mechanisms are receiving layers, and the receiving layers are positioned opposite to the adhesive layers such that when each receiving layer contacts the opposing adhesive layer, the first shell piece is coupled to the second shell piece to form the shell.

13. A system for providing a modular lamp, comprising:

a shell having a first shell piece and at least a second shell piece, wherein a hook is affixed to one of an interior wall of the first shell piece or an interior wall of the second shell piece; and a skeletal structure comprising a pole, a pole base, and a light fixture;

wherein the pole has a hole that receives the hook to allow the skeletal structure to be securely coupled in place relative to the shell when the first shell piece and the second shell piece are coupled to form the shell, and at least portions of the skeletal structure are contained within a shell interior of the shell when the first shell piece and the second shell piece are coupled to form the shell.

14. The system for a modular lamp of claim 13, wherein a hook receptacle is affixed to either an interior wall of the first shell piece or an interior wall of the second shell piece, preferably not the shell piece to which the hook is affixed, such that, after the hook is received by the hole, the hook is further received by the hook receptacle, thus allowing the first shell piece to be coupled to the second shell piece to form the shell and allowing the skeletal structure to be securely coupled in place relative to the shell.

15. The system for a modular lamp of claim 13, wherein at least one or more first coupling mechanisms are affixed to the interior wall of the first shell piece, at least one or more second coupling mechanisms are affixed to the interior wall of the second shell piece, and the first coupling mechanisms and the second coupling mechanisms allow the first shell piece to be coupled to the second shell piece to form the shell.

* * * * *